US007669562B2

(12) United States Patent
Maehara et al.

(10) Patent No.: US 7,669,562 B2
(45) Date of Patent: Mar. 2, 2010

(54) MULTI-CYLINDER ENGINE WITH CYLINDER PAUSING FUNCTION

(75) Inventors: Hayato Maehara, Saitama (JP); Shinji Saito, Saitama (JP); Takaaki Tsukui, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 148 days.

(21) Appl. No.: 12/079,359

(22) Filed: Mar. 26, 2008

(65) Prior Publication Data

US 2008/0236523 A1 Oct. 2, 2008

(30) Foreign Application Priority Data

Mar. 30, 2007 (JP) ..... 2007-095702

(51) Int. Cl.
*F01L 9/02* (2006.01)

(52) U.S. Cl. ..... 123/90.12; 123/90.16; 123/90.31; 123/90.48; 123/193.5; 74/569

(58) Field of Classification Search ..... 123/90.12, 123/90.13, 90.15, 90.16, 90.17, 90.27, 90.31, 123/90.48, 90.52, 90.55, 193.3, 193.5, 195 C, 123/198 F; 74/567, 569
See application file for complete search history.

(56) References Cited

U.S. PATENT DOCUMENTS 6,318,316 B1 11/2001 Tsukui et al.
6,571,758 B2 * 6/2003 Tsukui et al. ..... 123/90.16
7,188,600 B1 3/2007 Maehara et al.
7,210,454 B2 5/2007 Maehara et al.

FOREIGN PATENT DOCUMENTS

| | | |
|---|---|---|
| JP | 2000-205038 | 7/2000 |
| JP | 2000-303850 | 10/2000 |
| JP | 2002-180812 | 6/2002 |
| JP | 2005-090463 | 4/2005 |
| JP | 2006-283578 | 10/2006 |

* cited by examiner

*Primary Examiner*—Ching Chang
(74) *Attorney, Agent, or Firm*—Carrier, Blackman & Associates, PC; Joseph P. Carrier; William D. Blackman

(57) ABSTRACT

In a multi-cylinder engine provided with a cylinder pausing function, a hydraulically-operated valve-pausing mechanism is capable of selectively suspending operation of at least one intake or exhaust valve of one or more selected cylinders, depending on engine operating conditions, such that the suspended valve is temporarily held in a closed state. A hydraulic-pressure control device, for controlling hydraulic pressure supplied to the valve-pausing mechanism, is disposed on an engine body so as to minimize an amount of protrusion of the hydraulic-pressure control device from the engine body, while situating the hydraulic-pressure control device near the valve-pausing mechanism. A recess portion is formed on an external surface of a cylinder head or a head cover, and the hydraulic-pressure control device is disposed on the engine such that at least part of the hydraulic-pressure control device is accommodated in the recess portion.

20 Claims, 9 Drawing Sheets

MULTI-CYLINDER ENGINE WITH CYLINDER PAUSING FUNCTION

CROSS-REFERENCE TO RELATED APPLICATIONS

The present invention claims priority under 35 USC 119 based on Japanese patent application No. 2007-095702, filed on Mar. 30, 2007. The entire disclosure of this priority document, including specification, claims and drawings, is incorporated by reference herein.

BACKGROUND OF THE INVENTION

1. Technical Field of the Invention

The present invention relates to a multi-cylinder engine with a cylinder pausing function, in which a valve chamber is formed between a cylinder head and a head cover of an engine body having a plurality of cylinders. A valve-actuating mechanism is accommodated in the valve chamber in order to selectively operate intake and exhaust valves in the cylinder head. A hydraulically-operated valve-pausing mechanism is capable of suspending operation of at least one of the intake and exhaust valves of one or more of the cylinders, depending on an operation state of the engine, such that the suspended valve is held in a closed state in the valve-actuating mechanism. A hydraulic-pressure control device is disposed on the engine body for controlling hydraulic pressure supplied to the valve-pausing mechanism.

2. Background Art

A multi-cylinder engine is known in which the hydraulic pressure of a valve-pausing mechanism, disposed in a valve-actuating mechanism, is selectively controlled to temporarily suspend operation of at least one intake valve or exhaust valve of one or more cylinders such that the at least one of the intake and exhaust valves is held closed, whereby an operation of a part of the cylinders is temporarily suspendable, depending on an operation state of the engine.

Examples of this known type of engine are described in published Japanese Patent Document JP-A No. 2000-205038 (Patent Document 1) and published Japanese Patent Document JP-A No. 2006-283578 (Patent Document 2). In an arrangement disclosed in Patent Document 1, a hydraulic-pressure control device is disposed in a rear surface of a cylinder head where a plurality of intake ports are disposed, so as to place the hydraulic-pressure control device near a valve-pausing mechanism. In an arrangement disclosed in Patent Document 2, a hydraulic-pressure control device is disposed in an upper surface of a head cover.

In each of the above-referenced arrangements, the hydraulic-pressure control device is disposed in an external surface of the cylinder head or the head cover, and thus the hydraulic-pressure control device protrudes from the external surface of the cylinder head or the head cover. Hence, in the arrangement of Patent Document 1, the hydraulic-pressure control device limits freedom of design for positions of the intake ports and an air intake system, and in the arrangement of Patent Document 2 the hydraulic-pressure control device limits a position of a member disposed above the head cover, such as a fuel tank.

SUMMARY OF THE INVENTION

The present invention has been developed in view of the above-described problems, and an object hereof is to provide a multi-cylinder engine with a cylinder pausing function, in which a hydraulic-pressure control device is disposed near a valve-pausing mechanism, with protrusion of the hydraulic-pressure control device from an engine body component being minimized.

To attain the above object, an arrangement of the invention defined in a first aspect hereof provides a multi-cylinder engine with a cylinder pausing function, in which a valve chamber is formed between a cylinder head of an engine body having a plurality of cylinders, and a head cover connected with the cylinder head, a valve-actuating mechanism is accommodated in the valve chamber in order to operate an intake valve and an exhaust valve that are disposed in the cylinder head for each of the cylinders such that the intake valve and the exhaust valve are openable and closable, a hydraulically-operated valve-pausing mechanism capable of suspending, depending on the operation state of the engine, an operation of at least one of the intake valve and the exhaust valve of a part of the cylinders such that the at least one of the intake valve and the exhaust valve is held in a closed state is disposed in the valve-actuating mechanism, and a hydraulic-pressure control device for controlling the hydraulic pressure of the valve-pausing mechanism is disposed in the engine body.

An embodiment of the invention defined in a second aspect hereof provides the multi-cylinder engine with a cylinder pausing function according to the first aspect, wherein the valve-actuating mechanism includes an intake and an exhaust camshaft that respectively correspond to the intake valve and the exhaust valve and extend parallel to each other, and the recess portion is disposed in the external surface of the cylinder head or the head cover at a position corresponding to a space between the intake and exhaust camshafts.

An embodiment of the invention defined in a third aspect hereof provides the multi-cylinder engine with a cylinder pausing function according to the second aspect, wherein a torque transmission device including a timing gear, for transmitting rotation of a crankshaft to the intake and exhaust camshafts, is connected with one end of the camshafts, and the hydraulic-pressure control device is disposed on the other end of the camshafts opposite the torque transmission device.

An embodiment of the invention defined in a fourth aspect hereof provides the multi-cylinder engine with a cylinder pausing function according to the second aspect, wherein the hydraulic-pressure control device includes a spool valve and a solenoid valve, having substantially parallel axes of operation and being accommodated in the recess portion formed in a side surface of the cylinder head in an orientation such that axes of operations of the spool valve and the solenoid valve are substantially parallel to axes of the cylinders.

An embodiment of the invention defined in a fifth aspect hereof provides the multi-cylinder engine with a cylinder pausing function according to the second aspect, wherein the hydraulic-pressure control device includes the spool valve and the solenoid valve, having substantially parallel axes of operation, is accommodated in the recess portion formed in an upper surface of the head cover in an orientation such that axes of operations of the spool valve and the solenoid valve are parallel to axes of the intake and exhaust camshafts.

According to the arrangement defined in the first aspect hereof, the hydraulic-pressure control device is accommodated in the recess portion formed in at least one of the cylinder head and the head cover. Hence, it is enabled to dispose the hydraulic-pressure control device near the valve-pausing mechanism with an amount of protrusion of the hydraulic-pressure control device from the cylinder head or the head cover minimized. Therefore, a freedom in choice of a position of another member disposed near the hydraulic-pressure control device can be increased. Further, in a case where the engine is installed in a motorcycle, for instance, the hydraulic-pressure control device can be protected against flying gravel and others.

According to the arrangement defined in the second aspect hereof, the recess portion can be disposed by efficiently utilizing the space between the intake and exhaust camshafts that are parallel to each other, and it is easy to form the recess portion with a sufficient depth, thereby contributing to minimization of the amount of protrusion of the hydraulic-pressure control device from the cylinder head or the head cover.

According to the arrangement defined in the third aspect hereof, the hydraulic-pressure control device is disposed on the side opposite to the torque transmission device, thereby further effectively minimizing the amount of protrusion of the hydraulic-pressure control device from the cylinder head or the head cover.

According to the arrangement defined in the fourth aspect hereof, the hydraulic-pressure control device is accommodated in the recess portion in the cylinder head, with the axes of operations being parallel to the axes of the cylinders. Hence, the amount of protrusion of the hydraulic-pressure control device from the side surface of the cylinder head is effectively minimized.

According to the arrangement defined in the fifth aspect hereof, the hydraulic-pressure control device is accommodated in the recess portion in the head cover, with the axes of operations being parallel to the axes of the camshafts. Hence, the amount of protrusion of the hydraulic-pressure control device from the upper surface of the head cover is effectively minimized.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

Figure 1:
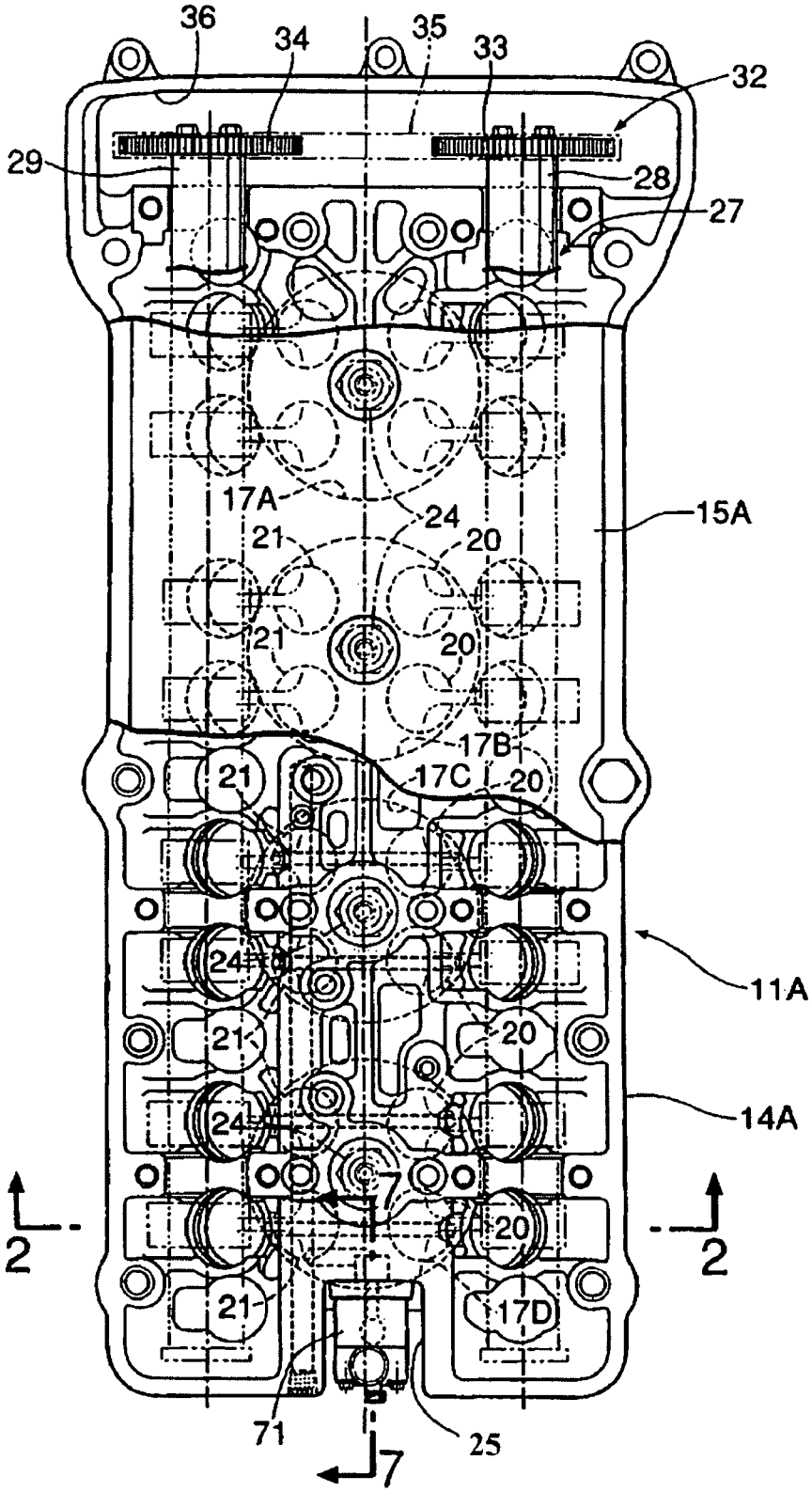
FIG. 1 is a partially-cut away top plan view of an engine body according to a first embodiment of the present invention.

A number of selected illustrative embodiments of the invention will now be described, with reference to the accompanying drawings. The best mode currently contemplated for carrying out the present invention is included in the following description. Throughout the present specification, relative positional terms like 'upper', 'lower', 'front', 'rear', 'top', 'bottom', 'horizontal', 'vertical', and the like are used to refer to the orientation of the apparatus as shown in the drawings. These terms are used in an illustrative sense to describe the depicted embodiments, and are not meant to limit the invention to the described orientation. It will be understood that the depicted apparatus may be placed at an orientation different from that shown in the drawings, such as inverted 180 degrees or transverse to that shown, and in such a case, the above-identified relative positional terms will no longer be accurate.

Figure 2:
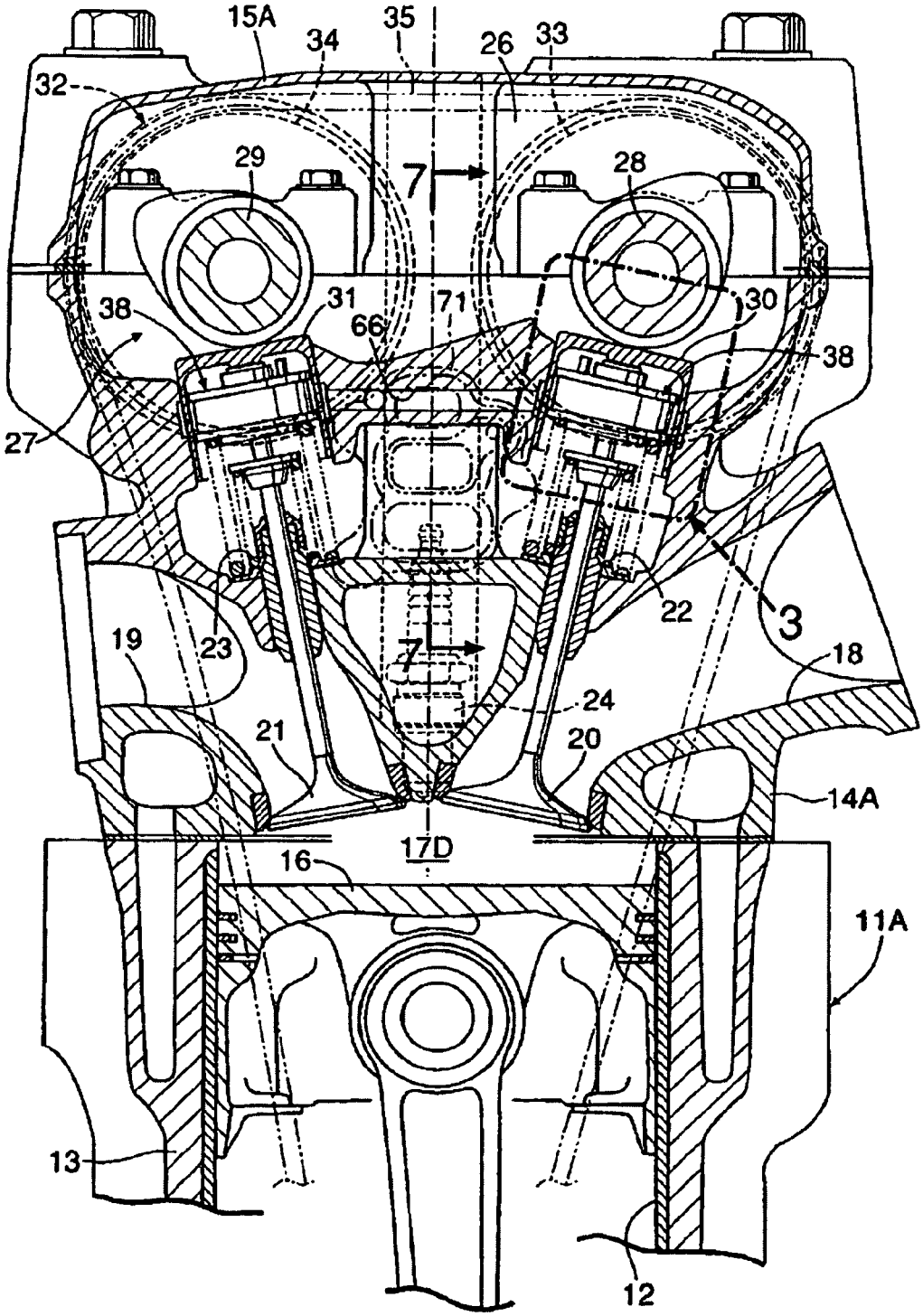
FIG. 2 is an enlarged cross-sectional detail view of an upper portion of the engine body, taken along the line 2-2 in FIG. 1.

FIGS. 1 to 8 illustrate an engine according to a first embodiment of the present invention. Referring first to FIGS. 1 and 2, an engine body 11A of a multi-cylinder engine, e.g., an inline four-cylinder engine, includes a cylinder block 13, having four cylinder bores 12 formed therein and arranged in a line parallel to an axis of a crankshaft C. The engine body 11A also includes a cylinder head 14A attached to an upper portion of the cylinder block 13, and a head cover 15A attached to an upper portion of the cylinder head 14A. As shown in FIG. 1, in this first depicted embodiment, the cylinder head 14A has a substantially rectangular cutout notch or recess 25 formed in an end portion thereof.

The engine body 11A is installed in a vehicle such as a motorcycle (not shown), such that the direction along which the cylinder bores 12 are arranged, i.e., a direction parallel to the axis of the crankshaft C, is parallel to a transverse direction of the motorcycle or other vehicle. In other words, in this first embodiment of the invention, the engine is arranged with its crankshaft axis oriented substantially transverse to a longitudinal front-to-rear direction of the vehicle.

A piston 16 is slidably fitted in each of the respective cylinder bores 12. First to fourth combustion chambers 17A, 17B, 17C, 17D, respectively, are formed between the cylinder block 13 and the cylinder head 14A, and top portions of the pistons 16 face toward the respective combustion chambers 17A, 17B, 17C, 17D.

The cylinder head 14A also has four intake ports 18 and four exhaust ports 19 formed therein, such that one intake port 18 and one exhaust port 19 are in communication with each of the respective combustion chambers 17A to 17D. The intake ports 18 open at a rear wall (right-hand side wall as seen in FIG. 2) of the cylinder head 14A that faces toward the rear side of the motorcycle. Conversely, the exhaust ports 19 open at a front wall (left-hand side wall as seen in FIG. 2) of the cylinder head 14A, that faces toward the front side of the motorcycle.

The cylinder head 14A also has a pair of intake valves 20 disposed therein for each of the respective combustion chambers 17A to 17D, such that the intake valves 20 are selectively operable to establish and disconnect communication between each of the intake ports 18 and its corresponding combustion chamber 17A to 17D. Similarly, the cylinder head 14A has a pair of exhaust valves 21 disposed therein for each of the respective combustion chambers 17A to 17D, such that the exhaust valves 21 are selectively operable to establish and disconnect communication between each of the exhaust ports 19 and the combustion chamber 17A to 17D.

The intake valves 20 and exhaust valves 21 are biased by valve springs 22 and 23, respectively, in a valve closing direction. Spark plugs 24 are attached to the cylinder head 14A and disposed on axes of the respective cylinder bores 12, to face central portions of the first to fourth combustion chambers 17A to 17D, respectively.

The intake valves 20 and the exhaust valves 21 are selectively opened and closed by a valve-actuating mechanism 27, accommodated in a valve chamber 26 which is formed between the cylinder head 14A and the head cover 15A. The valve-actuating mechanism 27 includes intake and exhaust camshafts 28 and 29, respectively, disposed parallel to each other above the intake valves 20 and the exhaust valves 21 to respectively correspond thereto. The valve-actuating mechanism 27 also includes intake valve lifters 30 that are bottomed cylindrical members fitted in the cylinder head 14A slidably between the intake camshaft 28 and the intake valves 20 so as to be slidably reciprocally movable in accordance with rotation of the intake camshaft 28, and exhaust valve lifters 31 that are bottomed cylindrical members fitted in the cylinder head 14A between the exhaust camshaft 29 and the exhaust valves 21 so as to be slidably reciprocally movable in accordance with rotation of the exhaust camshaft 29.

Further, end portions of the intake and exhaust camshafts 28, 29 at are connected to a torque transmission device 32 that transmits rotation of the crankshaft at a speed-reducing ratio of ½. The torque transmission device 32 includes an intake cam sprocket 33 and an exhaust cam sprocket 34 that are respectively fixed to the end portions of the intake and exhaust camshafts 28, 29, a drive sprocket fixed to the crankshaft, and a timing chain 35 wound around the driven sprockets 33, 34 and the drive sprocket. A timing chain passage 36, along which the timing chain 35 is entrained, is formed in the cylinder block 13 and the cylinder head 14A.

Among the four cylinders arranged in line, two cylinders on the side opposite to the torque transmission device 32, namely, two cylinders having the third and fourth combustion chambers 17C, 17D, are capable of being held in a cylinder pausing state, depending on the operation state of the engine, by holding at least one of the intake and exhaust valves 20, 21 in a suspended state, where at least one of the intake valves 20 and the exhaust valves 21 is held closed.

In this embodiment, the valve-actuating mechanism 27 is constructed such that in the cylinder pausing state, both the intake valves 20 and the exhaust valves 21 corresponding to the third and fourth combustion chambers 17C, 17D are held in the suspended state, and hydraulically-operated valve-pausing mechanisms 38, for holding the intake and exhaust valves 20, 21 in the suspended state, are disposed in the respective intake and exhaust valve lifters 30, 31 of the valve-actuating mechanism 27.

Figure 3:
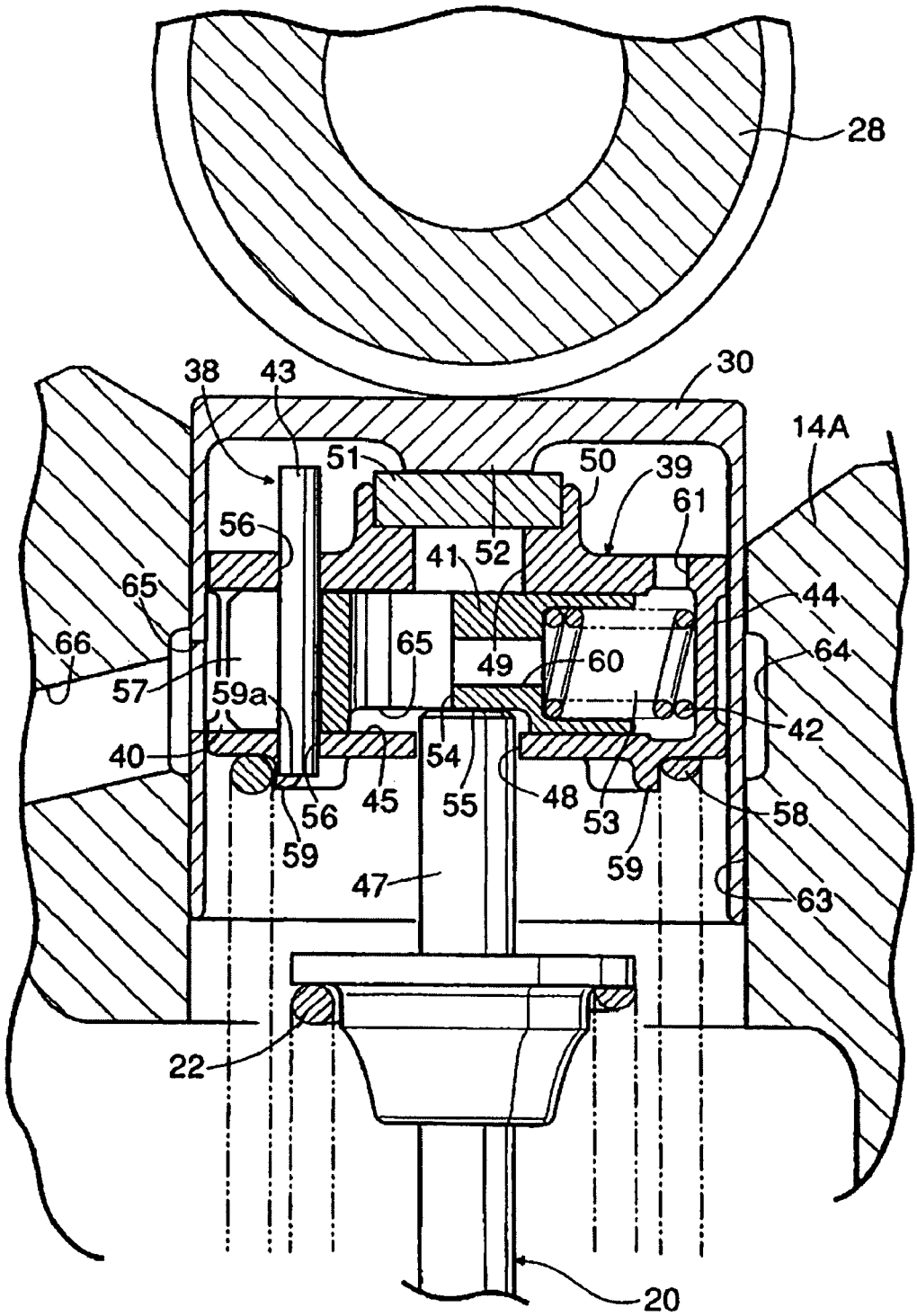
FIG. 3 is an enlarged detail view of a valve train part indicated by the arrow 3 in FIG. 2.

As shown in FIG. 3, the valve-pausing mechanism 38, disposed in the intake valve lifter 30, includes a pin holder 39 slidably fitted in the intake valve lifter 30, a slide pin 41, and a return spring 42 disposed between the slide pin 41 and the pin holder 39. The slide pin 41 is slidably fitted in a bore or sliding hole 45 formed in the pin holder 39, such that a hydraulic chamber 40 is formed between an inner surface of the intake valve lifter 30 and the slide pin 41. The return spring 42 exerts an outward spring force on the slide pin 41, pushing the slide pin outwardly which tends to decrease an inner volume of the hydraulic chamber 40.

The valve-pausing mechanism 38 also includes a stopper pin 43 disposed between the slide pin 41 and the pin holder 39. The stopper pin fits into a slot 57 formed in an outward-facing end of the slide pin (see FIG. 6). The stopper pin 43 is oriented substantially vertically in the depicted embodiment, or substantially transverse to a longitudinal axis of the slide pin 41, such that the stopper pin 43 limits outward movement of the slide pin 41 in the sliding hole 45. The stopper pin therefore limits the slide pin's ability to decrease the inner volume of the hydraulic chamber 40, while simultaneously inhibiting rotation of the slide pin 41 around its own axis.

Figure 4:
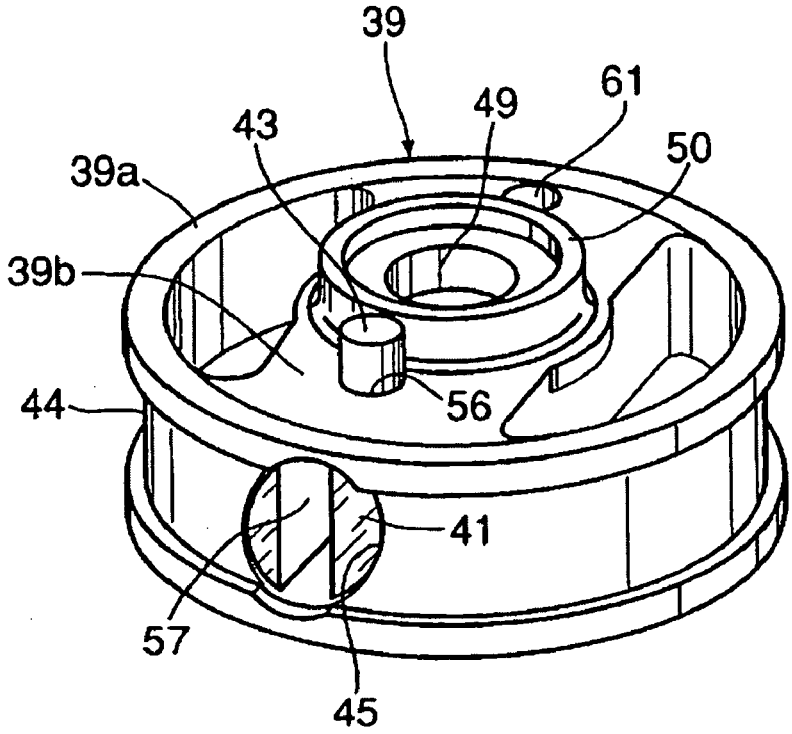
FIG. 4 is a perspective view of a pin holder as seen from the upper side, where the pin holder is a component of the valve train of FIG. 3.
Figure 5:
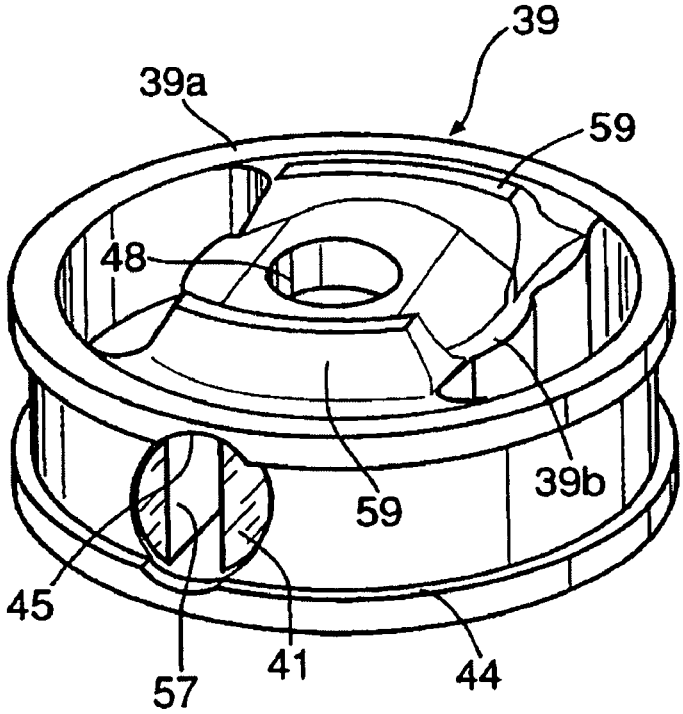
FIG. 5 is a perspective view of the pin holder of FIG. 4, as seen from the lower side.

Referring further to FIGS. 4 and 5, the pin holder 39 integrally includes both a ring portion 39*a*, and a bridge portion 39*b* extending centrally across the ring portion 39*a* along a diameter line thereof, as shown. The ring portion fits slidably in the intake valve lifter 30, while the bridge portion 39*b* connects two points on an inner circumferential surface of the ring portion 39*a*.

The pin holder 39 also has two lightening holes formed therein, as shown, inside of the ring portion 39*a* and on opposite sides of the bridge portion 39*b*. The lightening holes are provided in the pin holder 39 for weight-saving purposes. The pin holder 39 also has an annular groove 44 formed on an outer circumferential surface thereof, that is, on an outer circumferential surface of the ring portion 39*a*.

As noted, the pin holder 39 also has a bottomed sliding hole 45 (also referred to as sliding hole 45) formed longitudinally in a central part of the bridge portion 39*b*, to supportively receive the slide pin 41 therein. The sliding hole 45 has an axis which is co-linear with a central axis of the bridge portion 39*b*, and perpendicular to an axis of the intake valve lifter 30. The sliding hole 45 opens, at one of two opposite ends thereof, in the annular groove 44, as shown, and the other end of the sliding hole 45 is closed. The pin holder 39 also has an insertion hole 48 and an extension hole 49 formed therein at upper and lower central portions of the bridge portion 39*b*, respectively, where these two holes are coaxially aligned with one another. Inner ends of the insertion and extension holes 48, 49, respectively, open into the sliding hole 45. An end portion of a valve stem 47 of the intake valve 20 is inserted into and through the insertion hole 48. The extension hole 49 is formed coaxially with the insertion hole 48 at an upper side of the central portion of the bridge portion 39*b*, such that the end portion of the valve stem 47 can be accommodated in the extension hole 49. The sliding hole 45 is sandwiched between the insertion hole 48 and the extension hole 49.

A cylindrical accommodation portion 50, coaxial with the extension hole 49, is integrally formed at an upper portion of the bridge portion 39*b*, for placement below and adjacent a closed upper end of the intake valve lifter 30. A part of a disc-like shim 51 is fitted in the cylindrical accommodation portion 50. The disc-like shim 51 caps off an upper end of the extension hole 49, on the side of the closed end of the intake valve lifter 30. Further, a depending protrusion 52 is integrally formed at a central portion of an inner surface of the closed end of the intake valve lifter 30, and the upper surface of the disc-shaped shim 51 is brought into abutting contact with the depending protrusion.

The slide pin 41 is slidably fitted inside of the sliding hole 45 of the pin holder 39, as previously noted. As shown in FIG. 3, the hydraulic chamber 40 is formed inside of the sliding hole 45 between a bifurcated outwardly-facing end of the slide pin 41, near the stopper pin 43, and an inner surface of the intake valve lifter 30, in communication with the annular groove 44. The return spring 42 is accommodated in a spring chamber 53 formed between the other end of the slide pin 41 and a closed end of the sliding hole 45.

Figure 6:
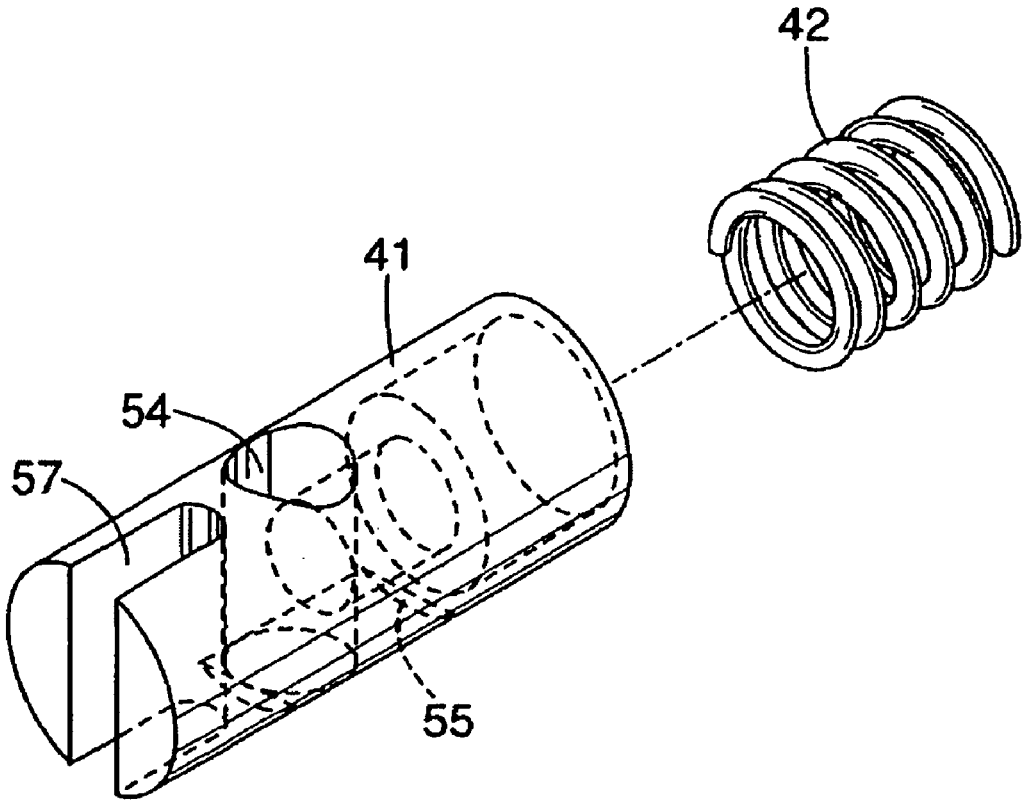
FIG. 6 is a perspective view of a slide piston and a return spring, which are components of the pin holder of FIGS. 4-5.

Referring further to FIG. 6, the slide pin 41 also has an accommodation hole 54 formed therein at an axially middle portion thereof to selectively receive the valve stem 47 under specified conditions. Specifically, when the slide pin is hydraulically moved to the right against the force of the spring 42 as shown in the diagram of FIG. 3, the accommodation hole 54 can be coaxially aligned with the insertion hole 48 and the extension hole 49, such that the end portion of the valve stem 47 can be accommodated therein.

A lower end of the accommodation hole 54, on the side of the insertion hole 48, opens in a plane contact surface 55 that is formed in a lower outer surface of the slide pin 41 to be opposed to the insertion hole 48. The plane contact surface 55 is relatively long in a direction of the axis of the slide pin 41, and the accommodation hole 54 opens in the plane contact surface 55 at a portion near the hydraulic chamber 40.

The slide pin 41 axially slides in equilibrium between a hydraulic force acting on an end of the slide pin 41 on the basis of the hydraulic pressure of the hydraulic chamber 40, and the spring force of the return spring 42 acting on the other end of the slide pin 41. When not operated with the hydraulic pressure of the hydraulic chamber 40 being low, the slide pin 41 is located at a position to displace the accommodation hole 54 from the axes of the insertion hole 48 and the extension hole 49 and to have an end of the valve stem 47 contact the contact surface 55, as shown in FIG. 3. When operated with the hydraulic pressure of the hydraulic chamber 40 being high, the slide pin 41 moves to the right as seen in FIG. 3, so that the end portion of the valve stem 47 inserted in the insertion hole 48 is accommodated in the accommodation hole 54 and the extension hole 49.

When the slide pin 41 is moved to the position to have the accommodation hole 54 axially connected with the insertion hole 48 and the extension hole 49, in accordance with a sliding movement of the intake valve lifter 30 due to a pressing force from the intake camshaft 28, the pin holder 39 and the slide pin 41 move to the side of the intake valve 20 together with the intake valve lifter 30. However, merely the end portion of the valve stem 47 is accommodated in the accommodation hole 54 and the extension hole 49, and a pressing force does not act on the intake valve 20 in a valve opening direction from the intake valve lifter 30 and the pin holder 39. Thus, the intake valve 20 is held closed, that is, an operation thereof is suspended. When the slide pin 41 moves to the position to have the end portion of the valve stem 47 contact its contact surface 55, the intake valve lifter 30 slides due to a pressing force acting from the intake camshaft 28, and the pin holder 39 and the slide pin 41 move to the side of the intake valve 20 in accordance with the sliding movement of the intake valve lifter 30, whereby a pressing force acts on the intake valve 20 in the valve opening direction. Thus, the intake valve 20 operates or opens and closes in accordance with rotation of the intake camshaft 28.

If the slide pin 41 rotates around its own axis inside the pin holder 39, the axis of the accommodation hole 54 and those of the insertion hole 48 and the extension hole 49 are brought out of alignment, and further it becomes impossible to have the end portion of the valve stem 47 contact the contact surface 55. Hence, the stopper pin 43 is provided in order to inhibit the slide pin 41 from rotating around its own axis.

The stopper pin 43 is journaled into an attachment hole 56, which is formed in the bridge portion 39*b* of the pin holder 39 intersecting the diameter line of the sliding hole 45, such that an axis of the attachment hole 56 is coincident with that of the stopper pin 43 and parallel to that of the intake valve lifter 30. The stopper pin 43 extends through a slit 57 that is disposed at an end of the slide pin 41 to open into the hydraulic chamber 40. That is, the stopper pin 43 is attached to the pin holder 39 such that the stopper pin 43 extends through the slide pin 41, while allowing limited movement of the slide pin 41, in an axial direction thereof, between the slide pin and the closed end of the sliding hole 45. Movement of the slide pin 41 to the side of the hydraulic chamber 40 is limited by the slide pin contacting the stopper pin 43 in an area at the inner closed end of the slit 57.

A coil spring 58 (FIG. 3) is disposed between the pin holder 39 and the cylinder head 14A. The coil spring 58 biases the pin holder 39 upwardly in the depicted embodiment, in a direction to have the shim 51 attached to the pin holder 39 contact the protrusion 52 at the central inner surface of the valve lifter 30. The coil spring 58 surrounds the valve stem 47, at a position where an outer circumferential surface of the coil spring 58 does not contact the inner surface of the valve lifter 30.

A pair of protrusions 59, 59 are integrally formed on the bridge portion 39*b* of the pin holder 39. These protrusions 59, 59 position an end portion of the coil spring 58 in a direction perpendicular to an axis of the valve stem 47. The protrusions 59, 59 are integrally formed to protrude in an amount smaller than or equal to a diameter of a wire of the coil spring 58. Each protrusion 59 has a shape like a circular arc extending around the axis of the valve stem 47. One of the protrusions 59, 59 has a step portion 59*a* for inhibiting the stopper pin 43 to the side of the intake valve 20 by contacting an end of the stopper pin 43 on the side of the intake valve 20.

The slide pin 41 has a first communication hole 60 formed axially therein that communicates the spring chamber 53 with the accommodation hole 54, in order to prevent a change in pressure in the spring chamber 53 due to an axial movement of the slide pin 41. The pin holder 39 also has a second communication hole 61 formed therein that communicates between the spring chamber 53 and a space formed between the pin holder 39 and the intake valve lifter 30, in order to prevent a change in pressure in the space due to a temperature change.

The cylinder head 14A also has a support hole 63 formed therein, in which the intake valve lifter 30 is slidably fitted. The cylinder head 14A also has an annular recess 64 formed therein on an inner surface of the support hole 63 and provided for surrounding the intake valve lifter 30. A communication hole 65 is also formed in a side wall of the intake valve lifter 30, for permitting fluid communication between the annular recess 64 of the cylinder head 14A and the annular groove 44 of the pin holder 39, irrespective of whether the valve lifter 30 slides in the support hole 63 or not. Further, an oil supply passage 66 is formed in the cylinder head 14A, in communication with the annular recess 64.

A substantially identical valve-pausing mechanism 38 to that described in connection with the intake valve lifter 30 is also provided for the exhaust valve lifter 31, so a redundant description thereof is not necessary herein.

The hydraulic pressures in the hydraulic chambers 40 of the hydraulically-operated valve-pausing mechanisms 38 are controlled by a hydraulic-pressure control device 71, disposed in the cylinder head 14A, such that at least a part (in this embodiment, a large part) of the hydraulic-pressure control device 71 is accommodated in a recess 25 (FIGS. 1 and 7) formed in an external surface of a central end portion of the cylinder head 14A. The recess 25 is disposed at a position, on a longitudinal axis of the cylinder head 14A, corresponding to a space between the intake and exhaust camshafts 28, 29 of the valve-actuating mechanism 27. In this first embodiment, the recess 25 is formed in a left lateral side of the cylinder head 14A, which is opposite to the torque transmission device 32, such that the recess 25 extends a relatively long distance down a side portion of the cylinder head 14A in a direction parallel to the axes of the cylinder bores 12, i.e., the cylinder axes.

Figure 7:
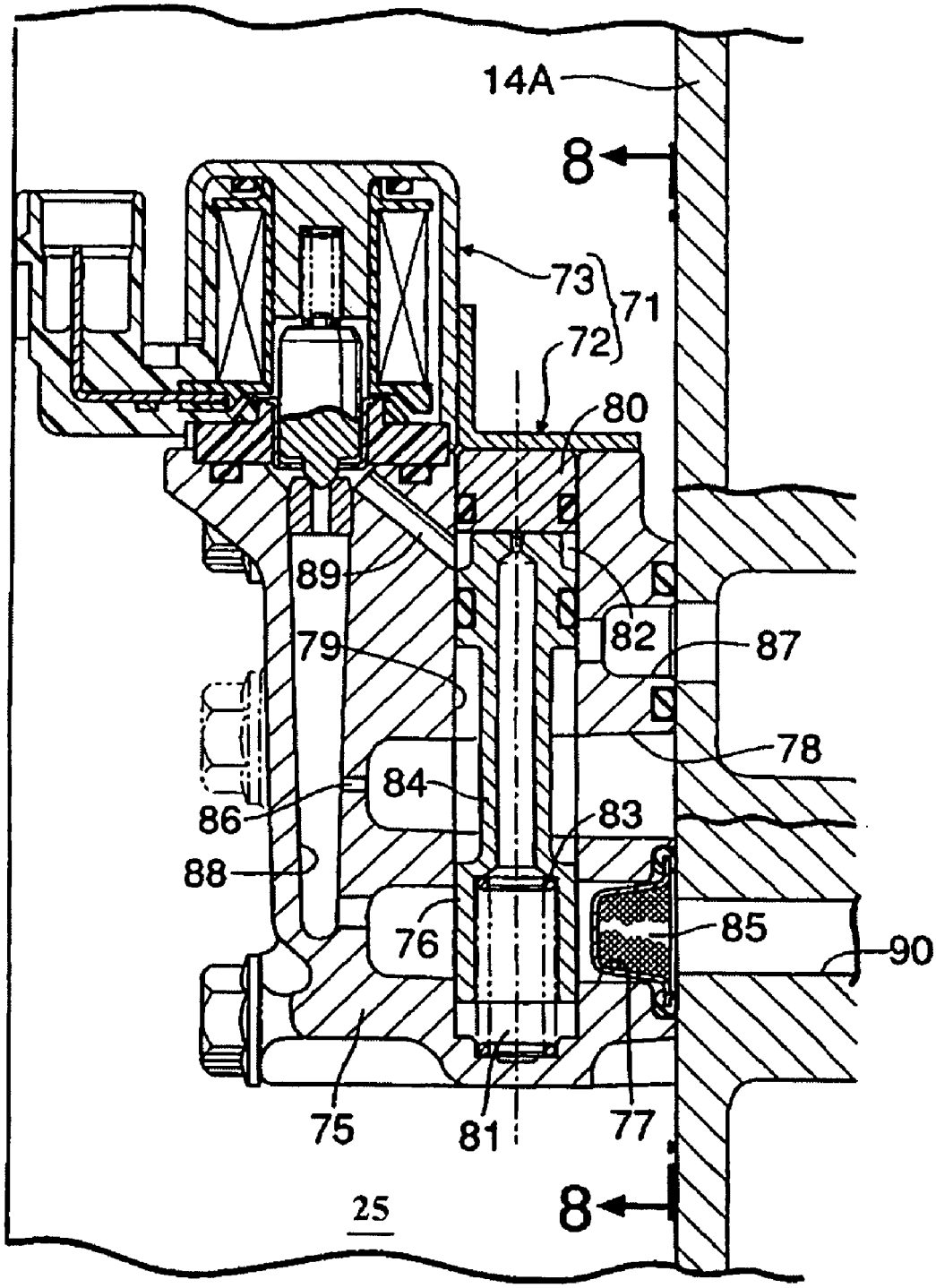
FIG. 7 is a cross-sectional detail view of a portion of the engine of FIGS. 1-2, taken along a line 7-7 in FIG. 1.
Figure 8:
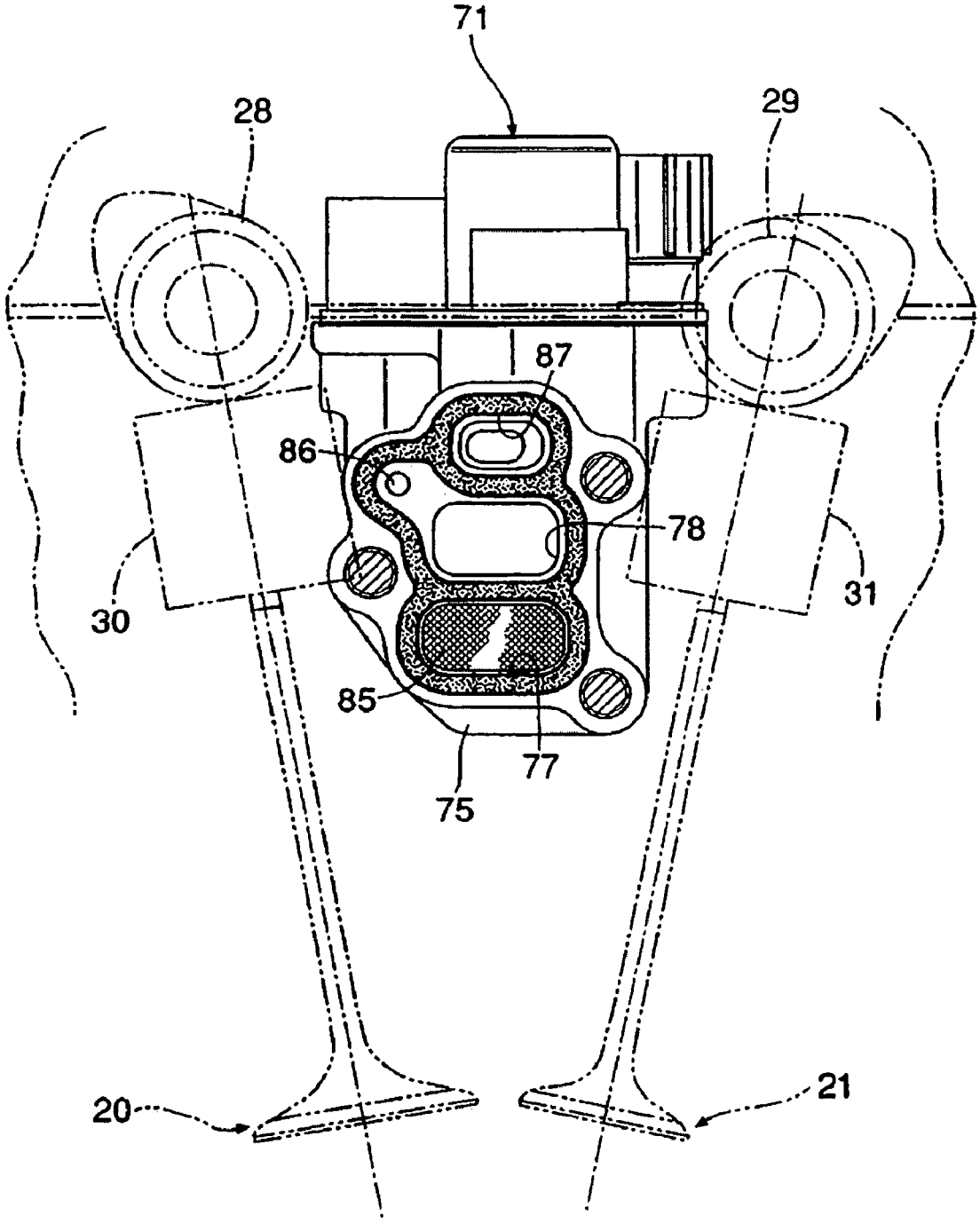
FIG. 8 is a sectional detail view of a portion of the engine as seen from a position of, and in a direction indicated by, arrows 8 in FIG. 7.

In FIGS. 7 and 8, the hydraulic-pressure control device 71 includes a spool valve 72 attached to the cylinder head 14A, and a solenoid valve 73 attached to the spool valve 72, with these components situated such that an axis of operation of the solenoid valve 73 extends substantially parallel to an axis of operation of the spool valve 72. The hydraulic-pressure control device 71 is accommodated in the recess 25 in an orientation such that the direction of operation of the spool valve 72 and the axis of operation of the solenoid valve 73 are parallel to the cylinder axes, i.e. are substantially vertical in the depicted embodiment.

The spool valve 72 includes a valve housing 75 fastened to the cylinder head 14A, where the valve housing is provided with an inlet port 77 and an outlet port 78. The valve housing 75 also has a bottomed slide bore 79 formed therein, which extends vertically in the embodiment of FIG. 7, with one of two opposite ends thereof closed and the other end thereof open. A cap 80 is fitted in the valve housing 75 to close the opening at the upper end of the slide bore 79.

The spool valve also includes a spool valve body 76, which is slidably fitted in the slide bore 79 of the valve housing 75. The valve housing 75 also has a spring chamber 81 defined therein between the spool valve body 76 and the closed end of the slide bore 79, and a pilot chamber 82 formed between the other end of the spool valve body 76 and the cap 80. A spring 83 is accommodated in the spring chamber 81, with an upper end of the spring being received in a cylindrical chamber formed in the bottom end of the spool valve body 76. The spring 83 therefore biases the spool valve body 76 upwardly, in a direction to decrease an inner volume of the pilot chamber 82.

The inlet port 77 and the outlet port 78 are formed in the valve housing 75 to open in an inner surface of the slide bore 79 at respective positions spaced away from each other in an axial direction of the slide bore 79. The spool valve body 76 has an annular recess 84 formed around a central portion thereof, capable of establishing fluid communication between the inlet port 77 and the outlet port 78. When the spool valve body 76 is moved to a position to minimize the inner volume of the pilot chamber 82, as shown in FIG. 7, the spool valve body 76 is placed in a position to disconnect the inlet port 77 and the outlet port 78 from each other.

The spool valve also includes an oil filter 85, attached the inlet port 77. An orifice hole 86 is formed through a wall of the valve housing 75, extending between a substantially vertical oil routing passage 88 and the outlet port 78, for selectively establishing communication between the inlet port 77 and the outlet port 78. Hence, when the spool valve body 76 is at the position to blockingly disconnect the inlet port 77 and the outlet port 78 from each other, as shown in FIG. 7, the inlet port 77 and the outlet port 78 communicate with each other indirectly, via the oil routing passage 88 and the orifice hole 86, during which flow of a working oil supplied into the inlet port 77 is narrowed at the orifice hole 86 and then proceeds into the outlet port 78.

Further, the valve housing 75 has a release port 87 formed through a wall thereof. The release port 87 communicates with the outlet port 78 via the annular recess 84 only when the spool valve body 76 is located as shown in FIG. 7, at the position to blockingly disconnect the inlet port 77 and the outlet port 78 from each other. The release port 87 opens into the valve chamber 26, between the cylinder head 14A and the head cover 15A.

As noted, the valve housing 75 also has a substantially vertical oil routing passage 88 formed therein, which is always in communication with the inlet port 77. The oil routing passage 88 is selectively connectable to a connection hole 89 via the solenoid valve 73. The connection hole 89 is formed extending through a wall of the valve housing 75 at a downward angle, to selectively permit fluid communication between the oil routing passage and the pilot chamber 82.

Hence, when the solenoid valve 73 is operated and opened, the hydraulic pressure in the pilot chamber 82 is increased, and this increased hydraulic force drives the spool valve body 76 downwardly to increase the inner volume of the pilot chamber 82, whereby the inlet port 77 and the outlet port 78 are placed into direct fluid communication with each other via the annular recess 84 of the spool valve body 76, while the outlet port 78 and the release port 87 are disconnected from each other.

An oil pump (not shown), operatively associated with the crankshaft, is accommodated in a crankcase of the engine body 11A. Oil from the oil pump is supplied to the inlet port 77 of the hydraulic-pressure control device 71, via an oil supply passage 90 formed in the cylinder head 14A.

The activation oil passage 66 has two opposed ends, one of which is split into two branch portions (FIG. 2) which are in respective communication with the annular recesses 64 of the valve-pausing mechanisms 38. The other end of the activation oil passage 66 is disposed in the cylinder head 14A at a location to provide fluid communication with the outlet port 78 of the hydraulic-pressure control device 71.

Hence, when the solenoid valve 73 of the hydraulic-pressure control device 71 is operated and opened, the spool valve body 76 is forced downwardly against the force of the spring 81. As a result, the inlet port 77 and the outlet port 78 are placed into direct fluid communication with each other, whereby pressurized oil is fed into the activation oil passage 66 and a high hydraulic pressure acts on the hydraulic chambers 40 of the valve-pausing mechanisms 38. This pressurized oil activates the valve-pausing mechanisms 38 to temporarily hold the intake valves 20 and the exhaust valves 21 in the suspended state.

In contrast, when the solenoid valve 73 of the hydraulic-pressure control device 71 is closed, the inlet port 77 and the outlet port 78 are disconnected from each other, while the outlet port 78 is placed into fluid communication with the release port 87, whereby the hydraulic pressure of the hydraulic chambers 40 is decreased, and thus the slide pins 41 of the valve-pausing mechanisms 38 are moved by their associated springs 42 to the positions where the intake valves 20 and the exhaust valves 21 operate in the normal way.

There will be now described operations of the engine according to the first embodiment. Since the hydraulic-pressure control device 71 is accommodated in the recess 25 formed in the cylinder head 14A, the hydraulic-pressure control device 71 is therefore situated near the valve-pausing mechanisms 38 of the valve-actuating mechanism 27, while minimizing the amount of protrusion of the hydraulic-pressure control device 71 outwardly from the cylinder head 14A, thereby reducing an influence of the location of the hydraulic-pressure control device 71 on the placement of other members near the hydraulic-pressure control device 71. In a case where the engine is to be installed in a vehicle such as a motorcycle, such embedding of the hydraulic-pressure control device 71 into the cylinder head also tends to protect the hydraulic-pressure control device against flying gravel.

Since the valve-actuating mechanism 27 has the intake and exhaust camshafts 28, 29 extending parallel to each other, and the recess 25 is formed on the external surface of the cylinder head 14A at a position corresponding to the space between the intake and exhaust camshafts 28, 29, the space between the intake and exhaust camshafts 28, 29, which would otherwise be substantially unused, is efficiently utilized for disposition of the recess 25, and it is easy to form the recess 25 with a sufficient depth. Hence, the amount of protrusion of the hydraulic-pressure control device 71 from the cylinder head 14A can be further minimized.

Further, the torque transmission device 32 is connected with the end portions of the intake and exhaust camshafts 28, 29 at one side of the cylinder head, and the recess 25 is disposed at the opposite end portions of the intake and exhaust camshafts 28, 29. Thus, by disposing the recess 25 on the side opposite to the torque transmission device 32, the amount of protrusion of the hydraulic-pressure control device 71 from the cylinder head 14A can be further effectively minimized.

The hydraulic-pressure control device 71 including the spool valve 72 and the solenoid valve 73, which have parallel axes of operation, is at least partially accommodated in the recess 25, which is formed on a side surface of the cylinder head 14A in a shape which extends long in a direction parallel to the cylinder axes. The hydraulic-pressure control device 71 is configured and arranged such that the axes of operations of the spool valve 72 and the solenoid valve 73 are substantially parallel to the cylinder axes. Hence, the hydraulic-pressure control device 71 is efficiently accommodated in the recess 25, thereby effectively minimizing the amount of protrusion of the hydraulic-pressure control device 71 from the cylinder head 14A.

Figure 9:
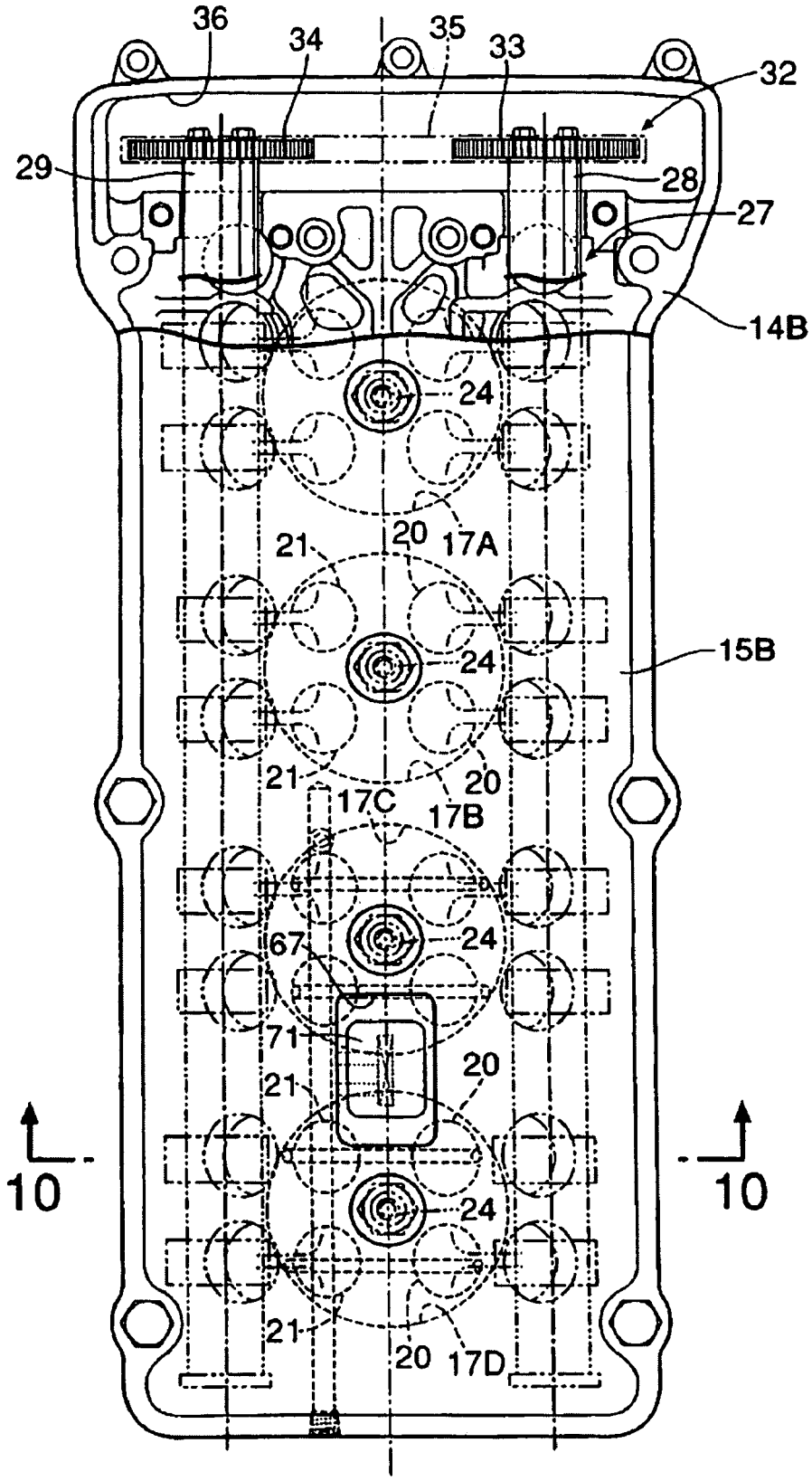
FIG. 9 is a partially-cut away top plan view of an engine body according to a second embodiment.
Figure 10:
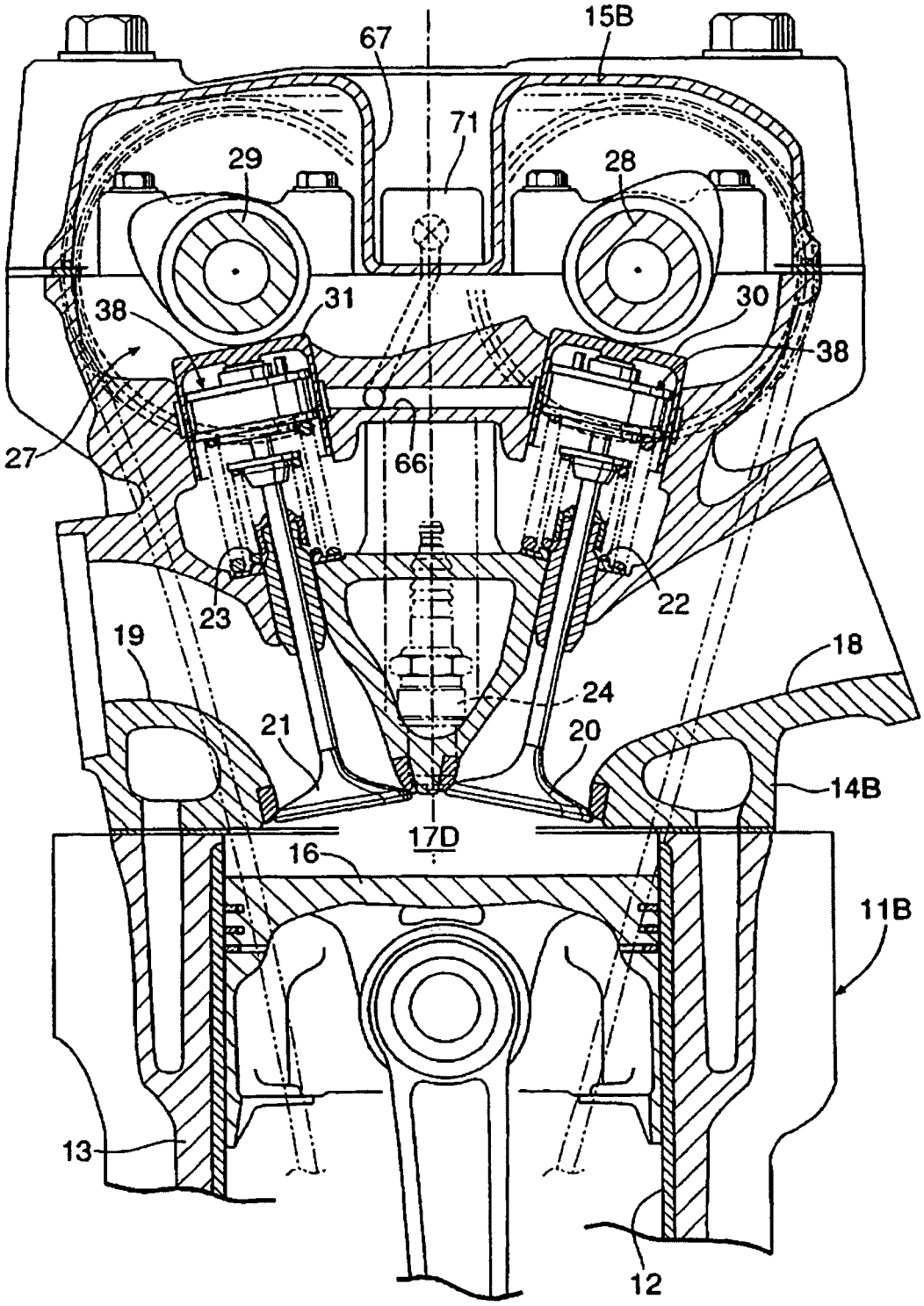
FIG. 10 is a cross-sectional view of the engine body of FIG. 9, taken along a line 10-10.

FIGS. 9 and 10 show a second embodiment of the invention, in which FIG. 9 is a top plan view of an engine body and corresponds to FIG. 1, and FIG. 10 is a cross-sectional view taken along a line 10-10 in FIG. 9.

Parts corresponding to those of the first embodiment are merely shown in the drawings with the same reference numerals assigned, and detailed description thereof is omitted.

An engine body 11B includes a cylinder block 13 having cylinder bores 12, a cylinder head 14B connected with the cylinder block 13, and a head cover 15B connected with the cylinder head 14B.

A valve-actuating mechanism 27, disposed in the cylinder head 14B and that operates or opens and closes intake valves 20 and exhaust valves 21, includes an intake and an exhaust camshaft 28, 29 that respectively correspond to the intake valves 20 and the exhaust valves 21, intake valve lifters 30 that are bottomed cylindrical members disposed between the intake camshaft 28 and the intake valves 20 and slidably fitted in the cylinder head 14B, and exhaust valve lifters 31 that are bottomed cylindrical members disposed between the exhaust camshaft 29 and the exhaust valves 21 and slidably fitted in the cylinder head 14B so as to reciprocate in accordance with rotation of the exhaust camshaft 29. End portions of the intake and exhaust camshafts 28, 29 at a side are connected to a torque transmission device 32 that transmits rotation of a crankshaft at a speed reducing ratio of ½.

Among four cylinders arranged in a line, two cylinders on the side opposite to the torque transmission device 32, namely, two cylinders having third and fourth combustion chambers 17C, 17D, are such that the intake valves 20 and the exhaust valves 21 thereof are capable of being held in a suspended state with the intake valves 20 and the exhaust valves 21 held closed, by means of hydraulically-operated valve-pausing mechanisms 38 disposed in the intake valve lifters 30 and the exhaust valve lifters 31.

A hydraulic-pressure control device 71, that controls the hydraulic pressure of the valve-pausing mechanisms 38, is disposed on an external surface of the head cover 15B, such that the hydraulic-pressure control device 71 is accommodated in a recess portion 67 formed on an upper surface of the head cover 15B.

The recess portion 67 is formed in the upper surface of the head cover 15B at a position corresponding to a space between the intake and exhaust camshafts 28, 29 of the valve-actuating mechanism 27. The recess portion 67 has a shape which extends long in a direction parallel to axes of the intake and exhaust camshafts 28, 29. The hydraulic-pressure control device 71 is accommodated in the recess portion 67 and located on the side of one of two ends of the intake and exhaust camshafts 28, 29 that is opposite to the torque transmission device 23.

In this second embodiment, the hydraulic-pressure control device 71 is accommodated in the recess portion 76 in an orientation such that axes of operations of a spool valve 72 (refer to the first embodiment) and a solenoid valve 73 (refer to the first embodiment) are oriented parallel to one another, and also to axes of the intake and exhaust camshafts 28, 29.

According to the second embodiment, an amount of protrusion of the hydraulic-pressure control device 71 from the head cover 15B is minimized, while disposing the hydraulic-pressure control device 71 near the valve-pausing mechanisms 38 of the valve-actuating mechanism 27, thereby reducing an influence on disposition of other members near the hydraulic-pressure control device 71. Further, in a case where the engine is installed in a motorcycle, for instance, the hydraulic-pressure control device 71 can be protected against flying gravel and other debris.

Further, since the recess portion 67 can be disposed by efficiently utilizing the space between the intake and exhaust camshafts 28, 29, and it is easy to form the recess portion 67 with a sufficient depth, the amount of protrusion of the hydraulic-pressure control device 71 from the head cover 15B is further effectively minimized.

Further, since the hydraulic-pressure control device 71 is disposed in the recess portion 67 and on the side opposite to the torque transmission device 32, the amount of protrusion of the hydraulic-pressure control device 71 from the head cover 15B is further effectively minimized.

Further, since the hydraulic-pressure control device 71 is accommodated in the recess portion 67 formed on the upper surface of the head cover 15B in a shape long in the direction parallel to the axes of the intake and exhaust camshafts 28, 29, such that the directions of operations are parallel to the axes of the intake and exhaust camshafts 28, 29, the hydraulic-pressure control device 71 can be efficiently accommodated in the recess portion 67, thereby effectively minimizing the amount of protrusion of the hydraulic-pressure control device 71 from the head cover 15B.

It is noted that the recess portion 67 of the head cover 15B may be formed exclusively for the hydraulic-pressure control device 71, or alternatively a part of a recess portion conventionally formed on the head cover 15B for another purpose than accommodation of the hydraulic-pressure control device 71 may be used as the recess portion 67.

When a plurality of hydraulic-pressure control devices 71 are used, it may be arranged such that recess portions are formed on a side surface of the cylinder block and an upper surface of the head cover, and the hydraulic-pressure control devices 71 are disposed in the recess portions.

Although a number of selected embodiments of the invention have been described herein, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. A multi-cylinder engine with a cylinder pausing function, said engine comprising:

a cylinder block having a plurality of cylinders formed therein;

a cylinder head attached to an upper portion of the cylinder block;

a cylinder head cover attached to an upper portion of the cylinder head, in which a valve chamber is formed between the cylinder head and the cylinder head cover, an intake valve and an exhaust valve slidably disposed in the cylinder head for each of the cylinders;

a valve-actuating mechanism accommodated in the valve chamber for selectively opening and closing the intake and exhaust valves;

a hydraulically operated valve-pausing mechanism for selectively suspending operation of at least one of the intake valve and the exhaust valve of one or more of the cylinders, depending on an operation state of the engine, such that the at least one of the intake valve and the exhaust valve is temporarily held in a closed state in the valve-actuating mechanism, and a hydraulic-pressure control device disposed in the engine for controlling hydraulic pressure supplied to the hydraulically-operated valve-pausing mechanism, wherein a recess portion is formed in an external surface of at least one of the cylinder head and the head cover, and the hydraulic-pressure control device is disposed on the cylinder head or the head cover such that at least a part of the hydraulic-pressure control device is accommodated in the recess portion.

2. The multi-cylinder engine with cylinder pausing function according to claim 1, wherein the valve-actuating mechanism comprises an intake camshaft and an exhaust camshaft that extend parallel to each other, and wherein the recess portion is disposed in the external surface of the cylinder head or the head cover at a position corresponding to a space between the intake and exhaust camshafts.

3. The multi-cylinder engine with cylinder pausing function according to claim 2, wherein the recess portion is formed in the cylinder head cover, wherein the hydraulic-pressure control device comprises a spool valve and a solenoid valve having substantially parallel axes of operation, and wherein said spool valve and said solenoid valve are accommodated in the recess portion formed in an upper surface of the cylinder head cover in an orientation such that respective axes of operation of the spool valve and the solenoid valve are substantially parallel to axes of the intake and exhaust camshafts.

4. The multi-cylinder engine with cylinder pausing function according to claim 2, wherein a torque transmission device, for transmitting rotation to the intake and exhaust camshafts, is connected with a first end of each of the intake and exhaust camshafts, respectively, and the hydraulic-pressure control device is disposed on another end of the intake and exhaust camshafts opposite said first end.

5. The multi-cylinder engine with cylinder pausing function according to claim 4, wherein the recess portion is formed in the cylinder head, wherein the hydraulic-pressure control device comprises a spool valve and a solenoid valve, and wherein at least part of the hydraulic-pressure control device is accommodated in the recess portion of the cylinder head.

6. The multi-cylinder engine with cylinder pausing function according to claim 5, wherein the spool valve and the solenoid valve are configured and oriented such that respective axes of operation thereof are substantially parallel to axes of the cylinders.

7. The multi-cylinder engine with cylinder pausing function according to claim 4, wherein the recess portion is formed in the cylinder head cover, wherein the hydraulic-pressure control device comprises a spool valve and a solenoid valve having substantially parallel axes of operation, and wherein said spool valve and said solenoid valve are accommodated in the recess portion formed in an upper surface of the cylinder head cover in an orientation such that respective axes of operation of the spool valve and the solenoid valve are substantially parallel to axes of the intake and exhaust camshafts.

8. The multi-cylinder engine with cylinder pausing function according to claim 2, wherein the recess portion is formed in the cylinder head, wherein the hydraulic-pressure control device comprises a spool valve and a solenoid valve, and wherein at least part of the hydraulic-pressure control device is accommodated in the recess portion of the cylinder head.

9. The multi-cylinder engine with cylinder pausing function according to claim 8, wherein the spool valve and the solenoid valve are configured and oriented such that respective axes of operation thereof are substantially parallel to axes of the cylinders.

10. The multi-cylinder engine with cylinder pausing function according to claim 1, wherein the hydraulic-pressure control device comprises a spool valve and a solenoid valve, wherein the spool valve comprises:

a valve housing having a plurality of passages formed therein including an inlet port, an exhaust port spaced away from the inlet port, and an oil routing passage, and a slide bore having a closed end and which is substantially transverse to a longitudinal axis of the inlet port, a spool valve body slidably disposed in the slide bore; and a spring disposed in the closed end of the slide bore for biasing the spool valve body in a first direction;

wherein said solenoid valve is operable to selectively and temporarily block oil flow through the oil routing passage.

11. A multi-cylinder engine with a cylinder pausing function, said engine comprising:

a cylinder block having a plurality of cylinders formed therein;

a cylinder head attached to an upper portion of the cylinder block;

a cylinder head cover attached to an upper portion of the cylinder head, in which a valve chamber is formed between the cylinder head and the cylinder head cover, an intake valve and an exhaust valve slidably disposed in the cylinder head for each of the cylinders;

a valve-actuating mechanism accommodated in the valve chamber for selectively opening and closing the intake and exhaust valves, said valve-actuating mechanism comprising an intake camshaft and an exhaust camshaft that extend parallel to each other;

a hydraulically operated valve-pausing mechanism for selectively suspending operation of at least one of the intake valve and the exhaust valve of one or more of the cylinders, depending on an operation state of the engine, such that the at least one of the intake valve and the exhaust valve is temporarily held in a closed state in the valve-actuating mechanism, and a hydraulic-pressure control device disposed in the engine for controlling hydraulic pressure supplied to the hydraulically-operated valve-pausing mechanism, wherein a recess portion is formed in an external surface of at least one of the cylinder head and the head cover at a position corresponding to a space between the intake and exhaust camshafts, and wherein the hydraulic-pressure control device is disposed on the cylinder head or the head cover such that at least a part of the hydraulic-pressure control device is accommodated in the recess portion.

12. The multi-cylinder engine with cylinder pausing function according to claim 11, wherein a torque transmission device, for transmitting rotation of a crankshaft to the intake and exhaust camshafts, is connected with a first end of each of the intake and exhaust camshafts, respectively, and the hydraulic-pressure control device is disposed on a side of the intake and exhaust camshafts opposite said first end.

13. The multi-cylinder engine with cylinder pausing function according to claim 12, wherein the hydraulic-pressure control device comprises a spool valve and a solenoid valve having substantially parallel axes of operation, said spool valve and said solenoid valve accommodated in the recess portion formed in an upper surface of the cylinder head cover in an orientation such that respective axes of operation of the spool valve and the solenoid valve are substantially parallel to axes of the intake and exhaust camshafts.

14. The multi-cylinder engine with cylinder pausing function according to claim 11, wherein the recess portion is formed in the cylinder head, and wherein the hydraulic-pressure control device comprises a spool valve and a solenoid valve which are accommodated in the recess portion formed in a side surface of the cylinder head.

15. The multi-cylinder engine with cylinder pausing function according to claim 11, wherein the spool valve and the solenoid valve are configured and oriented such that respective axes of operation of the spool valve and the solenoid valve are substantially parallel to axes of the cylinders.

16. The multi-cylinder engine with cylinder pausing function according to claim 15, wherein the recess portion is formed in the cylinder head, and wherein the hydraulic-pressure control device comprises a spool valve and a solenoid valve which are accommodated in the recess portion formed in a side surface of the cylinder head.

17. The multi-cylinder engine with cylinder pausing function according to claim 16, wherein the spool valve and the solenoid valve are configured and oriented such that respective axes of operation of the spool valve and the solenoid valve are substantially parallel to axes of the cylinders.

18. The multi-cylinder engine with cylinder pausing function according to claim 11, wherein the hydraulic-pressure control device comprises a spool valve and a solenoid valve having substantially parallel axes of operation, said spool valve and said solenoid valve accommodated in the recess portion formed in an upper surface of the cylinder head cover in an orientation such that respective axes of operation of the spool valve and the solenoid valve are substantially parallel to axes of the intake and exhaust camshafts.

19. The multi-cylinder engine with cylinder pausing function according to claim 11, wherein the hydraulic-pressure control device comprises a spool valve and a solenoid valve, wherein the spool valve comprises:

a valve housing having a plurality of passages formed therein including an inlet port, an exhaust port spaced away from the inlet port, and an oil routing passage, and a slide bore having a closed end and which is substantially transverse to a longitudinal axis of the inlet port;

a spool valve body slidably disposed in the slide bore; and a spring disposed in the closed end of the slide bore for biasing the spool valve body in a first direction;

wherein said solenoid valve is operable to selectively and temporarily block oil flow through the oil routing passage.

20. A multi-cylinder engine with a cylinder pausing function, said engine comprising:

a cylinder block having a plurality of cylinders formed therein;

a cylinder head attached to an upper portion of the cylinder block;

a cylinder head cover attached to an upper portion of the cylinder head, in which a valve chamber is formed between the cylinder head and the cylinder head cover;

an intake valve and an exhaust valve slidably disposed in the cylinder head for each of the cylinders;

a valve-actuating mechanism accommodated in the valve chamber for selectively opening and closing the intake and exhaust valves, said valve-actuating mechanism comprising an intake camshaft and an exhaust camshaft that extend parallel to each other;

wherein a timing sprocket, for transmitting rotation of a crankshaft to the intake and exhaust camshafts, is connected with a first end of each of the intake and exhaust camshafts, respectively;

a hydraulically operated valve-pausing mechanism for selectively and temporarily suspending operation of at least one of the intake valve and the exhaust valve of one or more of the cylinders, depending on an operation state of the engine, such that the at least one of the intake valve and the exhaust valve is temporarily held in a closed state in the valve-actuating mechanism; and a hydraulic-pressure control device disposed in the engine for controlling hydraulic pressure supplied to the hydraulically-operated valve-pausing mechanism;

wherein a recess portion is formed in an external surface of at least one of the cylinder head and the head cover at a position corresponding to a space between the intake and exhaust camshafts and proximate ends of the said intake and exhaust camshafts opposite said timing sprockets;

and wherein the hydraulic-pressure control device is disposed on the cylinder head or the head cover such that at least a part of the hydraulic-pressure control device is accommodated in the recess portion; the hydraulic-pressure control device comprising a spool valve and a solenoid valve;

wherein the spool valve comprises:

a valve housing having a plurality of passages formed therein including an inlet port, an exhaust port spaced away from the inlet port, and an oil routing passage, and a slide bore having a closed end and which is substantially transverse to a longitudinal axis of the inlet port;

a spool valve body slidably disposed in the slide bore; and a spring disposed in the closed end of the slide bore for biasing the spool valve body in a first direction;

wherein said solenoid valve is operable to selectively and temporarily block oil flow through the oil routing passage;

and wherein the hydraulic-pressure control device is disposed on a side of the intake and exhaust camshafts opposite said first end.

* * * * *